United States Patent [19]

Braun

[11] 3,966,394

[45] June 29, 1976

[54] PLURAL CLEANING ROLLS ASSEMBLY

[75] Inventor: Oskar J. Braun, Williamson, N.Y.

[73] Assignee: Xerox Corporation, Stamford, Conn.

[22] Filed: Apr. 30, 1975

[21] Appl. No.: 572,986

[52] U.S. Cl. ..... 432/75; 432/60; 15/256.52; 355/15; 118/60; 118/70; 15/1.5 R

[51] Int. Cl.[2] ..... G03G 13/20

[58] Field of Search ..... 432/59, 60, 75, 227, 432/228; 15/256.52, 77, 1.5; 355/15; 219/469, 216; 118/60, 70, 203, 104; 29/132

[56] References Cited

UNITED STATES PATENTS

| | | | |
|---|---|---|---|
| 3,579,697 | 5/1971 | Smith | 15/77 |
| 3,637,976 | 1/1972 | Ohta et al. | 432/60 |
| 3,716,018 | 2/1973 | Ohta et al. | 118/70 |
| 3,796,183 | 3/1974 | Thettu | 118/70 |
| 3,807,853 | 4/1974 | Hudson | 355/15 |
| 3,811,821 | 5/1974 | Ariyama et al. | 432/60 |
| 3,861,860 | 1/1975 | Thettu et al. | 432/59 |
| 3,861,861 | 1/1975 | Thettu | 432/59 |
| 3,868,744 | 3/1975 | Thettu | 15/256.52 |

*Primary Examiner*—John J. Camby
*Assistant Examiner*—Henry C. Yuen

[57] ABSTRACT

An improved plural cleaning rolls assembly for cleaning the residual toner particles from the heated fuser roll of a heated pressure fusing system in an electrostatic copy machine. The improved assembly includes a carriage supporting a plurality of cleaning rollers in contact with the surface of the heated fuser roll. A pressure loading mechanism applies a force on the carriage and cleaning rollers against the surface of the heated fuser roll. Each of the cleaning rollers is rotatably supported on a shaft which is connected to the carriage by a flexure member mounted on a shaft journaled in the carriage to enable independent flexure and alignment of the cleaning rolls relative to the fuser roll surface.

4 Claims, 5 Drawing Figures

PLURAL CLEANING ROLLS ASSEMBLY

This invention relates to fusing systems and in particular to an improved plural cleaning rolls assembly for removing toner particles from the fuser roll of a heated pressure fusing system.

In the practice of xerography as described in U.S. Pat. No. 2,297,691 to Chester F. Carlson, a xerographic surface comprising a layer of photoconductive insulating material affixed to a conductive backing is used to support electrostatic images. In the usual method of carrying out the process, the xerographic surface is electrostatically charged uniformly over its surface and then exposed to a light pattern of the image being produced to thereby discharge the charge in the areas where the light strikes the layer. The undischarged areas of the layer thus form an electrostatic charge pattern in conformity with the configuration of the original light pattern.

The latent electrostatic image can then be developed by contacting it with a finely divided electrostatically attractable material such as a powder. The powder is held in image areas by the electrostatic charges on the layer. Where the charge field is greatest, the greatest amount of powder is deposited; where the charge field is least, little or no material is deposited. Thus, a powder image is produced in conformity with the light image of the document or object being reproduced. The powder is subsequently transferred to a sheet of paper or other surface and suitably affixed thereto to form a permanent print.

One typical device for fixing the toner particles to the backing sheet is by a heated pressure fuser roll system in which the copy sheet is passed through the nip of a Teflon coated heated fuser roll and a backup roll as described in U.S. Pat. Nos. 3,256,002 and 3,268,351. In such fusing systems, care must be taken to remove unwanted toner particles from the heated fuser roll prior to its contact with the copy being fused. If care is not taken to keep the fuser roll free of toner particles, these toner particles can build up on the face of the fuser roll and degrade the quality of the fix by removing the fusing properties on the surface of the roll contacting the copy sheet and toner images. Furthermore, such unwanted toner particles can be released from the fusing roll upon its subsequent contact with the toner image to fuse toner particles to the copy sheet in non-imaged areas.

Normally unwanted or residual toner particles are removed from the surface of the fuser roll by a wick which also dispenses silicone oil to maintain the proper surface condition for release of the toner particles onto the wick as described in copending application Ser. No. 164,370 filed on July 20, 1971 and issued as U.S. Pat. No. 3,745,972 on July 17, 1973, entitled Improved Wicking Apparatus and commonly assigned with the instant application. It has been found that with the high-speed duplicating machines in present use that the wick devices often require frequent replacement which becomes costly. The present invention has the purpose of improving the cleaning of the heated fuser roll by plural cleaning rolls to extend the life of the wick device and also improve cleaning capability. Additionally, the cleaning rolls assembly of the invention is an improvement of the cleaning apparatus described in U.S. Pat. No. 3,868,744 commonly assigned herewith.

It is therefore an object of the present invention to improve heated pressure fusing systems.

It is another object of the present invention to enhance cleaning of fuser rolls having hard surfaces.

It is another object of the invention to enable actuating plural cleaning rollers which are supported to flex and align with a fuser roll being cleaned irrespective of a change in cleaning roll diameter differences.

It is still another object of the present invention to prevent uneven cleaning of fuser rolls.

It is still another object of the present invention to minimize unnecessary maintenance of copier/duplicator systems.

These and other objects of the instant invention are obtained by a new and improved cleaning roller assembly which comprises one or more cleaning rolls having a conformable surface which is independently aligned and flexed into pressure contact with a heated fuser roll surface being cleaned.

Further objects of this invention together with additional features and advantages thereof will become apparent from the following detailed description of the embodiment of the invention when read in conjunction with the accompanying drawings wherein.

Figure 1:
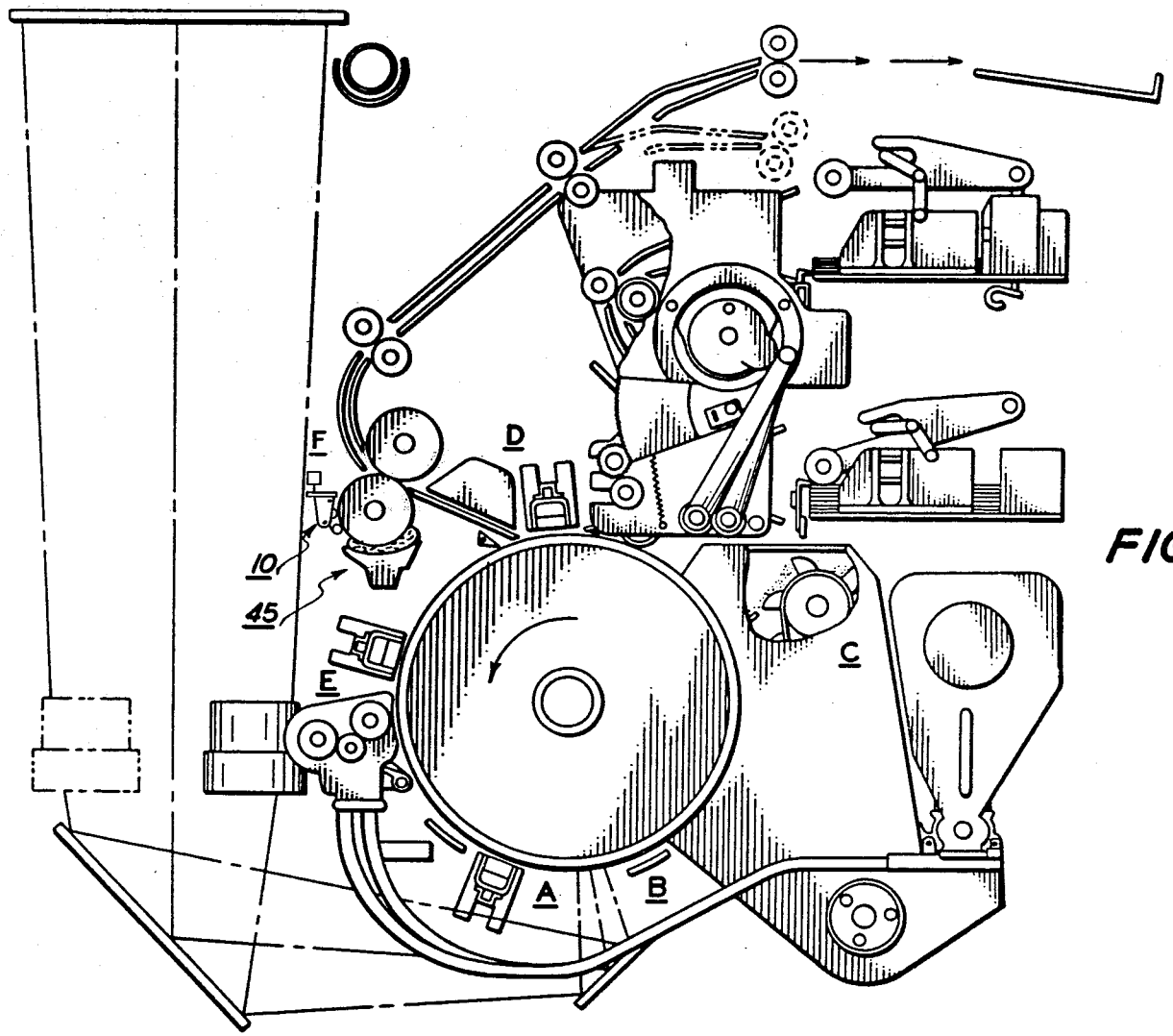
FIG. 1 is a schematic representation of an automatic xerographic reproducing machine incorporating a heated pressure fusing system utilizing the improved plural cleaning rolls assembly of the present invention.

Referring now to the drawings as shown in FIG. 1 an embodiment of the invention is a suitable environment such as an automatic xerographic reproducing machine. The automatic xerographic reproducing machine includes a xerographic plate or surface formed in the shape of a drum. The plate has a photoconductive layer or light receiving surface on a conductive backing journaled in a frame to rotate in a direction indicated by the arrow. The rotation will cause the plate surface to sequentially pass a series of xerographic processing stations.

For purposes of the present disclosure the several xerographic processing stations in the path of movement of the plate surface may be described functionally as follows:

A charging station A which the uniform electrostatic charge is deposited onto the photoconductive plate;

An exposure station B at which light or radiation pattern of copies to be reproduced is projected onto the plate surface to dissipate the charge in the exposed areas thereof to thereby form a latent electrostatic image of the copies to be reproduced;

A developing station C at which xerographic developing material including toner particles have an electrostatic charge opposite to that of the latent electrostatic image is cascaded over the latent electrostatic image to form a powdered image in configuration of the copy being reproduced;

A transfer station D which the powdered image is electrostatically transferred from the plate surface to a transfer material such as paper which is then passed through heated pressure fusing system having an improved cleaning roller assembly 10 according to the present invention as will be described hereinafter; and A drum cleaning and discharge station E at which the plate surface is brushed to remove residual toner particles remaining thereon after image transfer and at which the plate is exposed to a relatively bright light source to effect substantially complete discharge of any residual electrostatic charge remaining thereon.

For further details of the xerographic processing stations, above reference is made to copending application Ser. No. 838,902 filed July 3, 1969 issued as U.S. Pat. No. 3,578,859 on May 18, 1971.

Figure 2:
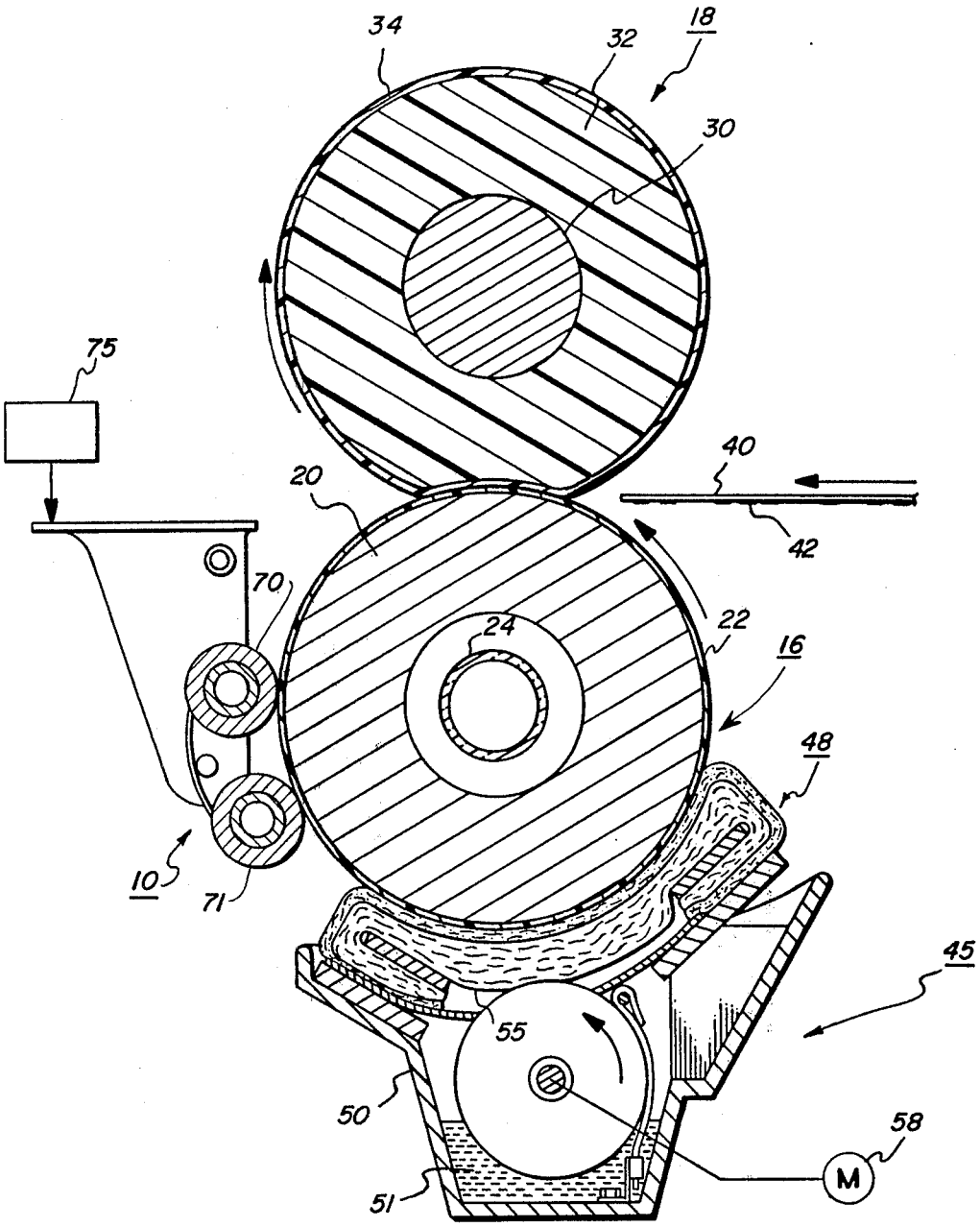
FIG. 2 is a side elevational view of the heated pressure fusing system and improved plural cleaning rolls assembly.

Referring now in particular to FIG. 2 there is shown details of the heated pressure fusing system which includes a heated fuser roll 16 and a backup pressure roll 18. Fuser roll 16 is a hollow circular cylinder with a metallic core 20 and a Teflon layer 22. A quartz lamp 24 serves as a source of thermal energy and is located at the center of the fuser roll. Power to the lamp is controlled by a thermal sensor generally called a thermister contacting the periphery of the fuser roll as described, for example, in U.S. Pat. No. 3,357,249. The backup roll 18 is also a circular cylinder and is made up of a metal core 30 surrounded by a thick rubber layer 32 and also a Teflon layer 34 to prevent soaking silicone oil into rubber layer 32 and subsequent swelling.

When the two rollers 16 and 18 are engaged as shown in FIG. 2 the applied load deforms the rubber in the pressure roll to provide the nip with a finite width. The copy sheet 40 electrostatically bearing the toner images 42 on the underside is brought into contact with the nip of the rolls with the toner image contacting the fuser roll 16. For a given temperature of the fuser roll, the fusing rate will depend upon the contact arc length of the support material against the dwell time, i.e. the time the toner images remain between the fuser roll 16 and the backup roll 18. Dwell time can be varied either by changing the surface velocity of the rolls or by varying the contact arc length and holding the speed of the roll the same. Contact arc length depends on the softness of the rubber on backup roll 18 and on the amount of pressure between the rolls 16 and 18. The mechanism for driving the rolls and for lowering and raising the rolls into contact can be accomplished by any suitable means, such as a mechanical camming device.

As a sheet of material is advanced between the rolls 16 and 18 the toner images on the support material will contact the peripheral heated surface of the roll 16 whereby the toner images become tackified and in this tackified condition the toner will tend to offset on this roll except that it is partially prevented from doing so by the Teflon coating on the roll. However, it is by the apparatus of the present invention which is successful in applying a thin film of offset preventing liquid such as silicone oil to the Teflon surface 22 of the fuser roll 16 such that toner offset is prevented as will be described hereinafter.

An oil dispensing apparatus 45 includes wicking assembly 48, an oil pan 50 for maintaining a supply of silicone oil 51 and an applicator roll 52. The oil pan is loaded against the heated fuser roll 16 by a spring action mounting (not shown) as details of the mounting form no part of the present invention. Applicator roll 52 is used to convey a thin film of oil to the bottom face 55 of the wicking assembly as the applicator roll is rotated in the direction shown by the arrow. Desirably, the applicator roll 52 is driven by an oil dispensing motor 58 which is energized during the fusing operation for a period depending upon the number of copies being produced.

Figure 3:
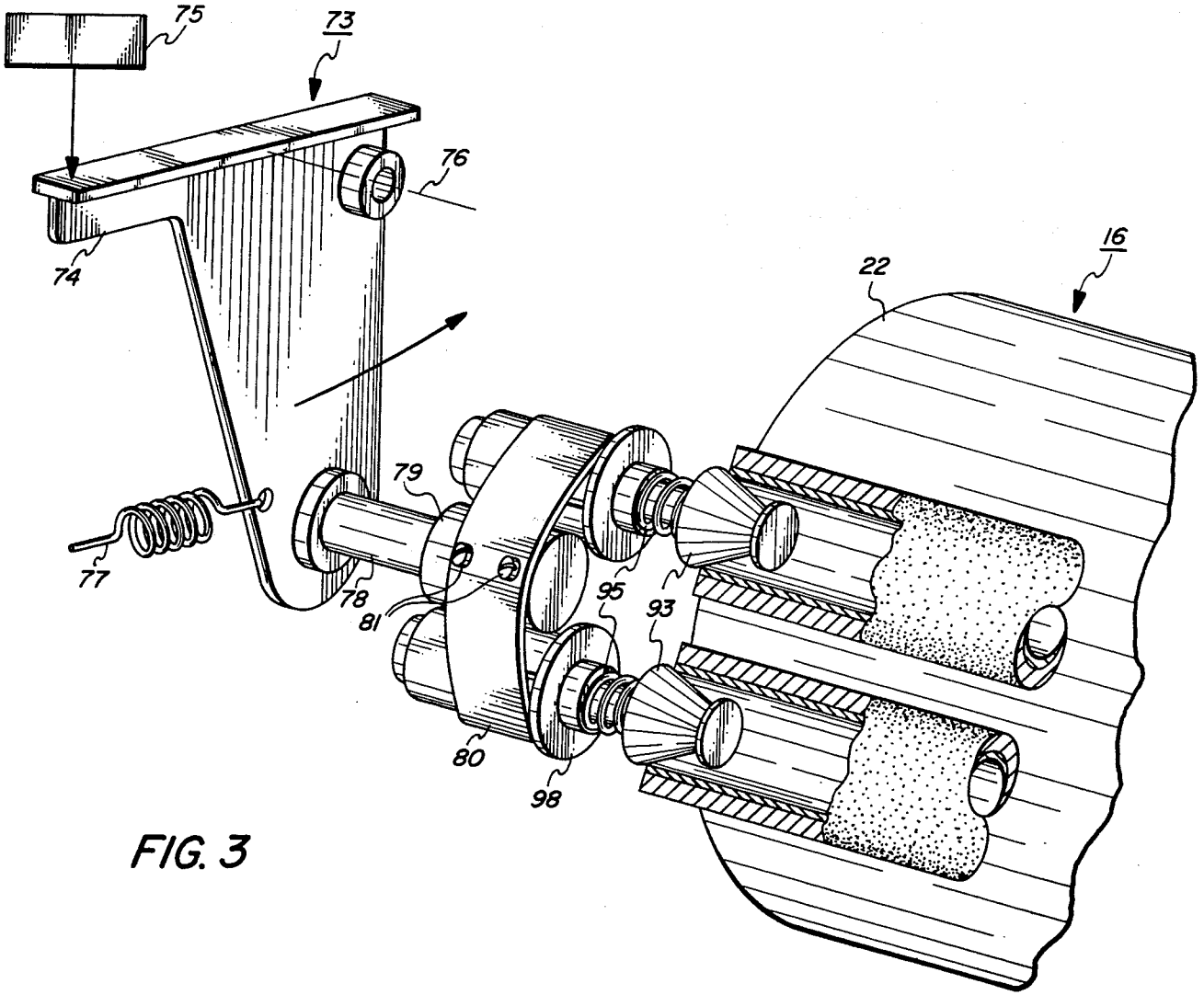
FIG. 3 is an isometric view of the improved cleaning rolls assembly according to the present invention with parts broken away to illustrate certain details.

In accordance with the present invention a plural cleaning rolls assembly 10 maintains the working heated surface of fuser roll 16 in a toner free condition thereby preventing unwanted residual toner particles from being redeposited upon subsequent copies as they are fused as will now be explained. The cleaning rolls assembly of the invention cleans any residual toner particles adhering to the surface of the heated fuser roll continuously and uniformly during the cleaning operation. The cleaning rolls assembly includes a plurality of cleaning rollers 70 and 71 which are constructed so as to have a soft and conformable surface to insure proper contact with the relatively hard exterior of the heated fuser roll 16. Cleaning rollers 70 and 71 are mounted on a movable holder or carriage 73. Carriage 73 is pressure biased by a loading mechanism 75 which enables the carriage to be capable of applying a uniform load both when the cleaning rollers are fully contaminated with toner particles or freshly installed. The loading mechanism may be actuated in any suitable manner and desirably maintains a force of about 2 to 4 pounds during the cleaning operation for a purpose to be described. In order to load the cleaning roller apparatus against fuser roll 16 an actuator lever 74 is pivoted on an axis on bass 76 in the direction of the arrow (FIG. 3). After the fusing operation spring loading mechanism 75 retracts and spring member 77 serves to move the cleaning roller apparatus away from the surface of fuser roll 16.

Cleaning roller apparatus 10 is pivotably supported from actuator lever 74 on a shaft member 78 journaled in bearing housing 79 to accommodate toner build on either of the cleaning rolls 70 or 71. In this manner uneven toner build-up on either of the cleaning rollers to a different diameter would be compensated for due to rotation of the apparatus on shaft member 78.

Force is applied to the cleaning rollers 70 and 71 from the loading mechanism 75 through actuator lever 74 to shaft member 78 and bearing housing 79 to a flexure member 80 which is secured to housing 79 as by screws 81. The flexure member 80 is formed with a loop on each end to receive a shaft assembly 90 which supports each of the cleaning rollers 70 and 71.

Figure 5:
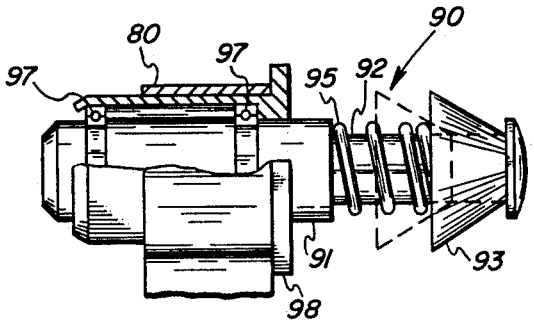
FIG. 5 is a side sectional view of the retractable shaft assembly of the plural cleaning rolls assembly.

Each cleaning roller is supportable on shaft assembly 90 (FIG. 5) such that the cleaning roller can be inserted and then locked into place to rotate freely when held against the surface of the heated fuser roll 16. Shaft assembly 90 includes a shaft 91 which has a plunger 92 which supports displaceable conical locking member 93 against the action of spring member 95. Shaft 91 is supported by a plurality of metal balls 97 axially spaced and received in a tubular housing 98 which is connected to carriage 73 by a flexure member 80. By this arrangement flexure member 80 enables independent alignment of each of the cleaning rolls end to end to allow independent flexing thereof.

Figure 4:
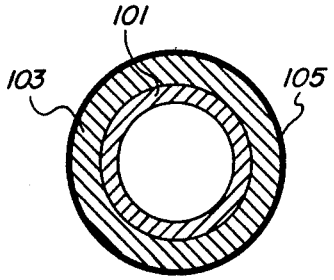
FIG. 4 is an end view of one cleaning roll.

Since each of the cleaning rolls has the same construction, it is deemed necessary to describe only one of them. The cleaning roll (FIG. 4) comprises a core 101 which is made out of a suitable lightweight material such as aluminum or plastic. Core 101 is covered with a soft deformable sleeve 103 to render a surface conformable to the heated fuser roll under the force of the loading mechanism. Any suitable material may be used for the sleeve which has the proper thermal and deforming properties. A preferred material is urethane foam or silicone rubber. The sleeve material may be placed onto the core in any suitable manner such as by an adhesive. Any suitable adhesive may be used, such as, Hypalon manufactured under the registered trademark of duPont Corporation, Wilmington, Delaware, or Ply-O-Bond HT manufactured under the registered trademark of Goodyear Corporation, Akron, Ohio. Where the core 101 is made of plastic bonding of urethane foam can be accomplished by ultrasonic welding.

The surface of the sleeve material is coated with a layer 105 of toner material which may be applied in any suitable manner, such as, by spraying, dipping, or sprinkling, or combinations thereof. The toner layer or coating desirably is uniform in thickness ranging from about .001 to about .005 inches. Any suitable toner material may be used. Typical toner materials are described in U.S. Re. 25,136 to Carlson.

In order to insure that the bond between the surface of the cleaning roller and the residual toner on the heated roll 16 is sufficiently strong to overcome the bond between the residual toner and the fuser roll, the toner coating on the cleaning roll is coated with a thin layer of silicone oil. The layer of silicone oil ranges from about 0.005 to about 0.1 microns. It has been found that the amount of silicone oil available on the fuser roll during start periods between the copies being produced and the end of the cycle is sufficient to keep enough oil on the cleaning roller surface to maintain proper cleaning. The cleaning roller is adjusted to touch the surface of the fuser roll to enable the cleaning roller to become coated with silicone oil for a brief interval at the start of every fuser operation. In this manner the cleaning roller maintains a sufficient oil film even during short operations.

In operation the toner material coating on the cleaning roller is raised to a sufficient temperature ranging from about 250°F to about 400°F the toner particles soften and change their state from a solid to a plastic or semi-molten state. During the plastic state, the adhesion between the individual particles of toner is at a maximum and in this manner the residual particles contacted by the cleaning roller are removed from the surface of the fuser roller onto the surface of the cleaning roller. By virtue of the lightweight core and foam sleeve the cleaning roller surface is soft and conforms to the contour and shape of the heated fuser roll. This enables substantially all of the residual toner particles to be cleaned and released from the entire surface of the heated fuser roll.

The loading of the carriage carrying the cleaning rollers into pressure contact with the heated fuser roll maintains the necessary temperature to the cleaning rollers to maintain their plastic state as well as enabling the cleaning rollers to conform and make uniform contact with the heated fuser roll. At the same time a more efficient cleaning of the fuser roll is accomplished due to the improved plural cleaning roll assembly which enables independent alignment of the cleaning rolls relative to the fuser roll surface is accomplished.

While the instant invention as to its objects and advantages has been described as being carried in a specific embodiment thereof it is not intended to be limited thereby but it is intended to be covered broadly within the scope of the appended claims.

What is claimed is:

1. In a fusing system for fusing toner images in an electrostatic copying machine in which a relatively hard heated roll surface is used to fix the toner images to copy sheet material, an improved plural cleaning rolls apparatus for cleaning toner offset onto the heated roll surface comprising:

a carriage means supporting at least two cleaning roll members in contact with a heated roll surface to be cleaned, pressure loading means for urging said carriage means towards the heated roll surface at a predetermined pressure, first shaft means rotatably mounted on said carriage means for supporting said cleaning roll members, each of said cleaning roller members including a core member exteriorly covered by a thermoplastic layer to create sufficient surface energy to collect toner from the heated roll surface, and second shaft means including a plurality of shaft members corresponding to and supporting an associated one of said core members for rotation thereof, and flexure means connecting said first shaft means to each of said shaft members whereby independent alignment of said shaft members and core members relative to the fuser roll is accomplished.

2. Apparatus according to claim 1 wherein said flexible member flexure means is arranged with loop portions to receive said shaft members.

3. Apparatus according to claim 1 wherein said pressure loading means exerts a force ranging from about 2 to about 4 pounds.

4. Apparatus according to claim 3 wherein spring means are connected to said carriage means to retract said carriage means after the pressure loading means is retracted therefrom.

* * * * *